US010610880B2

(12) United States Patent
Gao et al.

(10) Patent No.: US 10,610,880 B2
(45) Date of Patent: Apr. 7, 2020

(54) LOW FREQUENCY ELECTROSTATIC ULTRASONIC ATOMISING NOZZLE

(71) Applicant: JIANGSU UNIVERSITYY, Jiangsu (CN)

(72) Inventors: Jianmin Gao, Jiangsu (CN); Yiming Chen, Jiangsu (CN); Qiang Xu, Jiangsu (CN)

(73) Assignee: JIANGSU UNIVERSITY, Jiangsu (CN)

( * ) Notice: Subject to any disclaimer, the term of this patent is extended or adjusted under 35 U.S.C. 154(b) by 32 days.

(21) Appl. No.: 15/781,385

(22) PCT Filed: Apr. 28, 2016

(86) PCT No.: PCT/CN2016/080434

§ 371 (c)(1),
(2) Date: Jun. 4, 2018

(87) PCT Pub. No.: WO2017/166350

PCT Pub. Date: Oct. 5, 2017

(65) Prior Publication Data

US 2018/0361420 A1 Dec. 20, 2018

(30) Foreign Application Priority Data

Apr. 1, 2016 (CN) ..... 2016 1 0198692

(51) Int. Cl.
*B05B 17/06* (2006.01)
*B05B 5/03* (2006.01)
*B05B 5/053* (2006.01)

(52) U.S. Cl.
CPC ..... *B05B 17/0607* (2013.01); *B05B 5/03* (2013.01); *B05B 5/053* (2013.01); *B05B 17/063* (2013.01); *B05B 17/0653* (2013.01)

(58) Field of Classification Search
CPC . B05B 17/06; B05B 17/0607; B05B 17/0623; B05B 17/0653; B05B 5/053
(Continued)

(56) References Cited

FOREIGN PATENT DOCUMENTS

CN 102500502 A 6/2012
CN 103056061 A 4/2013
(Continued)

*Primary Examiner* — Christopher S Kim
(74) *Attorney, Agent, or Firm* — Saliwanchik, Lloyd & Eisenschenk

(57) ABSTRACT

The invention discloses a low-frequency electrostatic ultrasonic atomization nozzle that relates to an electrostatic atomizer in the field of agricultural engineering. The low-frequency electrostatic ultrasonic atomization nozzle comprises a transducer back cover, piezoelectric ceramics, a transducer front cover, an ultrasonic horn and a fastening screw. Furthermore, the fastening screw is set through the transducer back cover, the piezoelectric ceramics and the center round hole of the transducer front cover in sequence; a liquid inlet channel is designed in the axial center of the ultrasonic horn; an air intake channel is designed in a position that deviates from the axial center; the top of the ultrasonic horn is machined as a concave spherical surface; and a suspended ball is arranged on the concave spherical surface. Moreover, compressed air in the axial eccentric position is used for rotating the suspended ball at high speeds; a charging needle is electrified to generate an electric field for the suspended ball that the droplets generated by low-frequency ultrasonic atomization and can electrostatically atomize again, and it can make the droplets take on an electrostatic charge; finally, the electrified droplets are sprayed out from the nozzle. The low-frequency electrostatic ultrasonic atomization nozzle breaks through the bottleneck of a low-frequency ultrasonic atomization nozzle that struggles to generate ultrafine droplets and enables the
(Continued)

droplets to take on static electricity to increase adhesion so that the droplets can attach to crops more efficiently.

11 Claims, 8 Drawing Sheets

(58) Field of Classification Search
USPC ..... 239/102.2
See application file for complete search history.

(56) References Cited

FOREIGN PATENT DOCUMENTS

| | | | |
|---|---|---|---|
| CN | 103769338 | A | 5/2014 |
| CN | 104209222 | A | 12/2014 |
| CN | 104549813 | A | 4/2015 |
| KR | 101332445 | B1 | 12/2013 |

LOW FREQUENCY ELECTROSTATIC ULTRASONIC ATOMISING NOZZLE

FIELD OF THE INVENTION

The present invention relates generally to an ultrasonic nozzle and more particularly to an ultrasonic nozzle that utilizes an electrostatic apparatus and a sonic levitation mechanism.

BACKGROUND OF THE INVENTION

Ultrasonic atomization uses of electronic ultra-high frequency oscillation principle. In addition, the ultrasonic generator, working with a specific oscillation current frequency, produced a high-frequency power signal and converted the signal toward ultrasonic mechanical vibration through the transducer. Moreover, the ultrasonic vibration is propagated through a medium that needs to be atomized, and it causes the formation of a surface tension wave, which is formed at the gas-liquid interface. Due to ultrasonic cavitation, the surface tension waves produce a liquid molecule force and cause the liquid to become droplets from the liquid surface. This is the primary process of liquid atomization using ultrasonic waves. The ultrasonic atomization can form many droplets size up to the micron level. Ultrasonic atomization has many advantages in the field of agricultural engineering because it can form small droplets and has a wide range of applications in the field of agricultural engineering. High-frequency ultrasonic atomization (working frequency above 1 MHz) can change the physical and chemical properties of the atomized liquid to a large extent. Therefore, it is not suitable for the field of atomization cultivation (Aeroponics system) and plant protection. However, low-frequency ultrasonic atomization has less of an effect on the physical and chemical properties of the atomized liquid. However, the main problem associated with low-frequency ultrasonic atomization is that it forms droplets that are too large, resulting in reduced adhesion on the leaves and roots of crops.

A large number of research studies have shown that the charge can reduce the liquid surface tension and atomization resistance. Moreover, when the droplets carry the same charge, under the action of an electric field, it will break the large liquid molecules into smaller droplets with more uniform diameter distribution. Electrostatic atomization has been widely used in many applications including pesticide spraying, industrial spraying, material preparation, fuel combustion, industrial dust collection, desulfurization, particle aggregation and separation. The advantage of electrostatic spray is that the droplet adhesion characteristics are excellent. However, because of technical constraints, the electrostatic voltage of the critical voltage is between several kilo-volts to tens of thousands volts, which is called high-voltage electrostatic atomization. High-voltage electrostatic atomization has the following shortcomings: the voltage is between several kilo-volts to tens of kilo-volts, which is a great security risk for the operator; high-voltage static electricity beyond a certain extent will hurt crops, while low-voltage static electricity will promote the growth of crops; the structure of high-voltage electrostatic spray is complex and requires high cost manufacturing materials, especially those with good insulation properties; the most important thing is that the high-voltage static electricity requires high cost equipment.

SUMMARY OF THE INVENTION

The present invention aims to overcome the shortcomings of prior technology and provide a low-frequency electrostatic ultrasonic atomizer that produces ultrafine charged droplets under a low-frequency ultrasound and low static voltages to improve the adhesion of droplets to the crops.

To achieve the above objectives, the present invention adopts the following technical scheme:

The low-frequency electrostatic ultrasonic atomization nozzle comprises a transducer back cover, piezoelectric ceramics, a transducer front cover, an ultrasonic horn and a fastening screw. Furthermore, the fastening screw is set through the transducer back cover, the piezoelectric ceramics and the center round hole of the transducer front cover in sequence. The diameter of the fastening screw is smaller than the center hole of the piezoelectric ceramics to prevent a short circuit between the fastening screw and the piezoelectric ceramics, which would affect the normal operation of the nozzle. The transducer back cover, the piezoelectric ceramics, and the transducer front cover constitute the vibrator part of the low-frequency electrostatic ultrasonic atomizing nozzle. The length of the ultrasonic horn is arranged at the half-length of the ultrasonic wave, and the ultrasonic horn is provided with an inlet channel in the axial center. The rear part of the ultrasonic horn is provided with liquid in the radial direction, which is connected to the liquid inlet channel. An intake channel is arranged at an offset position from the axial center. The rear portion of the ultrasonic horn is provided with compressed air in the radial direction connected to the intake channel. The top of the ultrasonic horn is machined into a concave spherical surface, and a levitating ball is arranged on the concave spherical surface. Furthermore, the radius of curvature of the levitating ball is the same as that of the concave spherical surface of the ultrasonic horn. This design can form a focused ultrasound suspension system that can generate more acoustic levitation forces. Apart from this, the levitating ball is made of a metallic conductor. The outer surface of the levitating ball is arranged in the V-shaped annular groove, and the tip of the charging needle is provided in the V-shaped annular groove. The rear end of the charging needle is restrained by a spring to be in regular contact with the suspended ball; the charging needle is covered with an insulating sleeve, it is mounted on the bracket by means of a set, and the bracket is mounted on the flanges of the ultrasonic horn withset screws. The flange is designed at the node of the ultrasonic horn.

When the nozzle does not work because of gravity and charge injection pressure, the levitating ball firmly attaches to the top of the nozzle. However, when the nozzle is at work, under the drive of the piezoelectric ceramics, the front and back cover of the vibrator produce ultrasonic vibration, resonate with the horn, and generate a focused radiation sound field at the semicircular end. The sound field makes the levitating ball overcome gravity and the force from the charging needle, enabling the ball to be suspended upward to form a gap between the levitating ball and the top face of the horn. At the same time, the levitating ball undergoes high-speed rotation by the eccentric aerodynamic effect. To ensure that the ball can produce the acoustic suspension phenomenon, the front of the nozzle is designed as a concave spherical surface, resulting in a focused ultrasound suspension system to form a greater acoustic leeway.

There is an intake channel in the eccentric axial position of the nozzle, and the diameter of the inlet channel is approximately 1-2 mm. In the operation of the nozzle, compressed air with a flow rate of 50-100 m/s is passed into the intake channel. The compressed air causes the levitating ball to experience high-speed rotation, so that the droplets cannot stick to the suspended ball. Meanwhile, the high-speed rotation of the levitating ball colliding with the droplets causes the droplets to be atomized again.

The depth of the annular groove on the outer surface of the levitating ball is 1-2 mm, wherein the diameter of the insulating sleeve is 0.2-0.4 mm greater than the diameter of the spring and 0.05-0.1 mm less than the diameter of the socket. The spring can resist the insulation sleeve and restrict the charging needle to reciprocate in the socket.

The ultrasonic horn and transducer back cover are made of insulated ceramic materials. This ensures that the electrostatic field generated by the levitating ball does not affect the normal operation of the piezoelectric ceramics.

The levitating ball and the charging needle are made of copper. The surface of the charging needle is provided with an insulation sleeve to prevent the spring and sleeve from coming into direct contact with the charge. The diameter of the insulation sleeve is 0.2-0.4 mm larger than the spring diameter and 0.05-0.1 mm smaller than the sleeve diameter, which it can ensure that the charging needle and the levitating ball have regular contact. The upper surface of the socket is fixed to the bracket by welding. At the same time, a small hole is formed at the center of the contact of the holder and the sleeve so that the live wire can go into the socket and connect directly the charging needle to ensure that the charging needle is charged.

The bracket is a rectangular frame. The bracket and the horn are connected with bolts. The nuts and the ultrasonic horn are fitted with gaskets. The brackets and horns are bolted and have a simple structure to facilitate disassembly during installation or repair. At the same time, there are gaskets between the nuts and the horn of the nozzle to prevent the nuts from loosening during operation.

The main body of the ultrasonic vibrator consists of the horn, piezoelectric ceramics, the front cover of the transducer, the back cover of the transducer and the socket screw. The frequency of the main body is 25-30 kHz. The charging needle applies a static voltage of less than 500-2000 V to the suspended ball.

The nozzle drive circuit consists of choke inductor $L_{RFC}$, switch S, equivalent parallel capacitor C, series resonant inductance $L_1$, series resonant capacitor $C_1$ and impedance matching capacitor $C_P$.

The nozzle drive circuit, which is simple and efficient, is a single-ended circuit that is mainly composed of six parts: choke inductor $L_{RFL}$, switch S, equivalent parallel capacitor C (the sum of the switch input capacitor, the distributed capacitor and the external capacitor), series resonant inductor $L_1$, series resonant capacitor $C_1$, and impedance matching capacitor $C_P$. The operating principle is as follows: the square wave signal of working frequency f (nozzle series resonant frequency) controls the turning on and turning off of switch S. At this time, switch S outputs a pulse voltage. Through the frequency selection network $C$-$C_1$-$L_1$-$C_p$, the nozzle at both ends of the switching frequency f harmonic signal is suppressed, and the base frequency signal is selected. In this way, the two ends of the nozzle can obtain a square wave signal with the frequency of a sinusoidal AC signal. In addition, the frequency selective network can be used to adjust the load impedance. Simply put, when switch S is operated by the active square wave signal cycle, the DC energy from the power supply can be converted to AC energy. The frequency selection network can only let the base frequency current flow, thus encouraging the nozzle to work.

A simple analysis of the ultrasonic atomization drive circuit in the three stages of the work process is as follows:

First, choke inductance $L_{RFL}$ needs to be large enough to allow only the DC signal to pass through, while the AC signal has a large impedance, thereby suppressing the AC signal through. This causes the supply current not to drastically changes when the switch is turned on or off. Therefore, the input current can be considered as a constant flow.

Second, the fundamental frequency resonant circuit quality factor needs to be high enough. The flow passing through the ultrasonic nozzle can be regarded as a sine wave.

Finally, the conduction resistance of switch S is ignored, and switch S can instantaneously complete the process of turning on or off, which is the time for switch tube S to rise or fall to zero.

Compared with similar types of atomizers, the invention has the following technical effects:

1. By low-frequency ultrasonic atomization, electrostatic atomization, and centrifugation the liquid is atomized several times, so this nozzle can produce finer electrified droplets, increasing the possibility of adsorption by plants. The levitating ball in the sound field achieves suspension under the action of radiation. In the eccentric aerodynamic action, the levitating ball undergoes high-speed rotation, so that the charged droplets experience a centrifugal force at high speeds and can fly out and not stick to the ball. The liquid is vibrated by the ultrasonic horn for the first atomization process. Under the action of the electrostatic field, the droplets are subjected to the second atomization. Finally, the droplets collide with the levitating ball at high speed for the third atomization. For the liquid in the first atomization, the particle size is less than 60 microns, and the required voltage of the electrostatic secondary atomization is significantly reduced; thus, low-voltage electrostatic atomization is easy to achieve. The droplets were sprayed out by the centrifugal force and aerodynamic compound effect at high speeds after the third atomization.

2. The drive circuit structure is simple and highly efficient. The parasitic parameters of the circuit are effectively used. The junction capacitance of the switch tube is absorbed by the parallel capacitor of the resonant circuit, which can effectively reduce the influence of parasitic parameters on the circuit performance. The circuit produces little heat in the process of working and is able to drive the nozzle for a long time. At the same time, it has a high degree of reliability and can reduce maintenance costs in the process and improve the production efficiency.

BRIEF DESCRIPTION OF THE DRAWINGS

The present disclosure will be described with reference to the accompanying drawings, wherein like numbers reference like elements.

In these figures, 1—set; 2—charging nozzle; 3—ultrasonic horn; 4—inlet channel; 5—back cover; 6—piezoelectric ceramic; 7—intake channel; 8—suspended ball; 9—insulation sleeve; 10—spring; 11—bracket; 12—tightening screw; 13—bolt; 14—gasket; 15—nut 16—nutrient solution; 17—compressed air; 18—front cover;

$L_{RFL}$—choke inductor; S—switch; C—equivalent parallel capacitor (the sum of the switch tube input capacitor, the distributed capacitor and the external capacitor); $L_1$—series resonant inductor; $C_1$—series resonant capacitor; $C_p$—impedance matching capacitor; Vgs—drive signal of the switch S; Vs—voltage waveform across the switch S; is—current flowing through the switch S; is—current flowing through the parallel capacitor C; i—current flowing through the nozzle.

DESCRIPTION OF EXEMPLARY EMBODIMENTS

Figure 1:
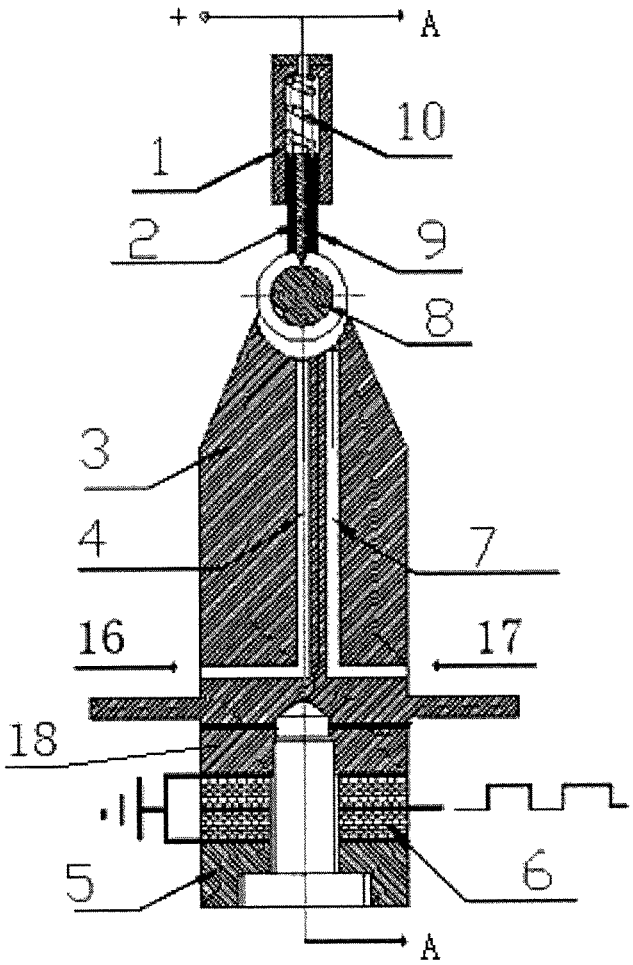
FIG. 1 is the schematic diagram of the static ultrasonic atomization nozzle structure.
Figure 2:
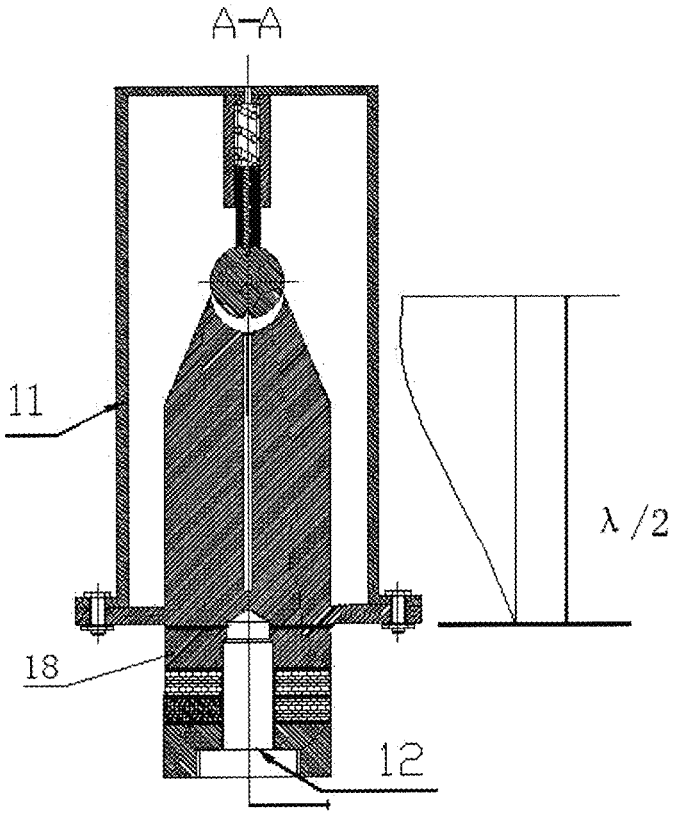
FIG. 2 is a side view of the static ultrasonic atomization nozzle.
Figure 3:
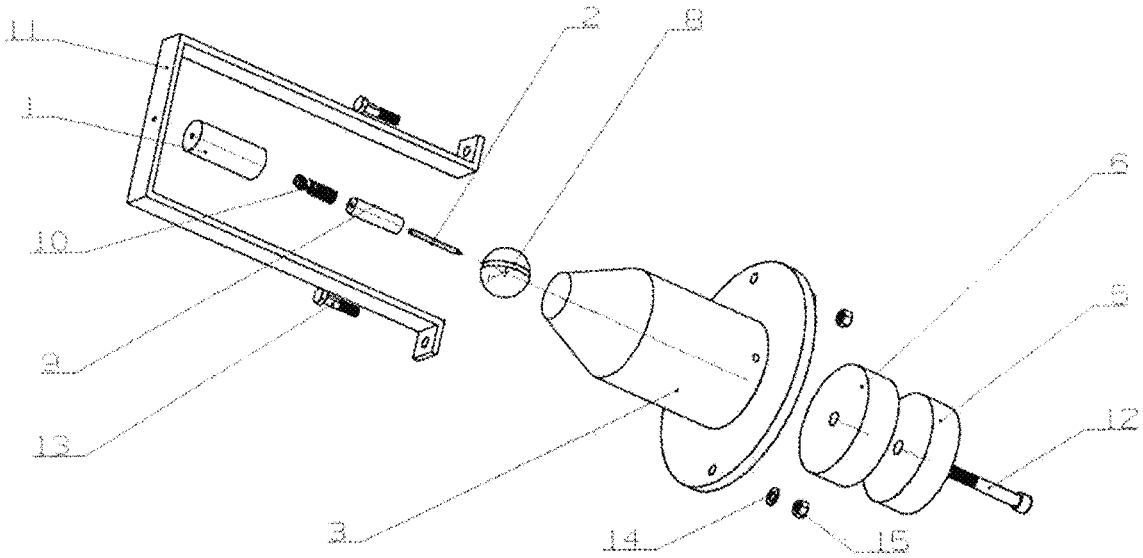
FIG. 3 is a schematic exploded 3-D diagram of the electrostatic ultrasonic atomization nozzle.

As shown in FIG. 1 and FIG. 2, the nozzle includes a horn 3, a front cover 18, a back cover 5, and piezoelectric ceramics 6 that generate ultrasonic vibrations. Among them, the vibration part of the nozzle is composed of three parts: a front cover 18, piezoelectric ceramics 6 and a back cover 5. The length of the horn 3 is a half-wavelength. The inlet channel 4 is designed in the axial center of the nozzle. The gas intake channel 7 is designed to deviate from the axial center at a certain position. The top of the nozzle is machined as a concave hemisphere and has a levitating ball 8 on it. The material of the levitating ball 8 is a metal conductor with a diameter of 15 mm and the outer surface of the levitating ball 8 has a V-shaped annular groove with a depth of approximately 1-2 mm. The top of the charging needle 2 is mounted in a V-shaped annular groove. The top of the charging needle 2 is provided with a spring 10 restraint, which ensures that the tip of the charging needle 2 can be in constant contact with the levitating ball 8. The surface of charging needle 2 has an insulation sleeve 9 mounted on the bracket 11 by a set 1. In addition, the bracket 11 is mounted at the node of the nozzle.

Figure 4A:
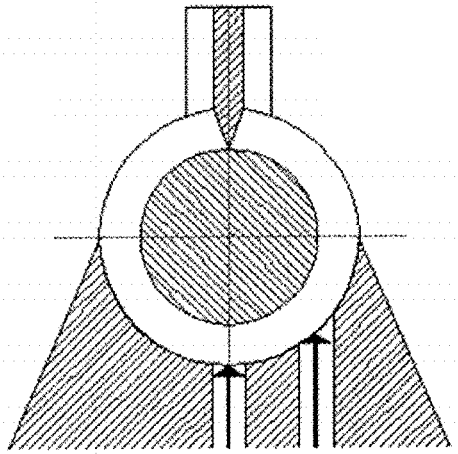
FIG. 4 is a diagram of the working process of the nozzle.
Figure 4B:
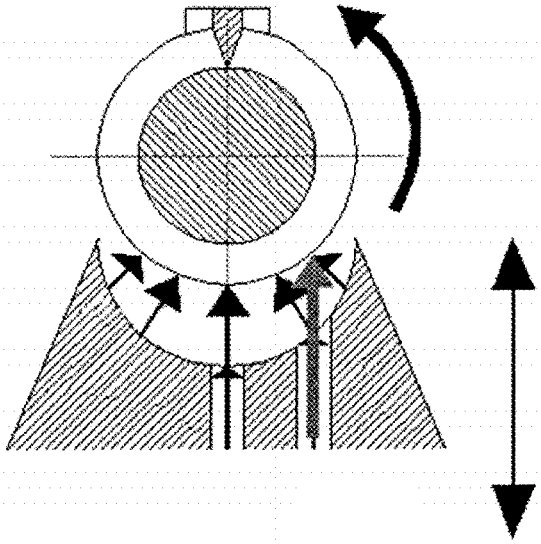
Figure 5:
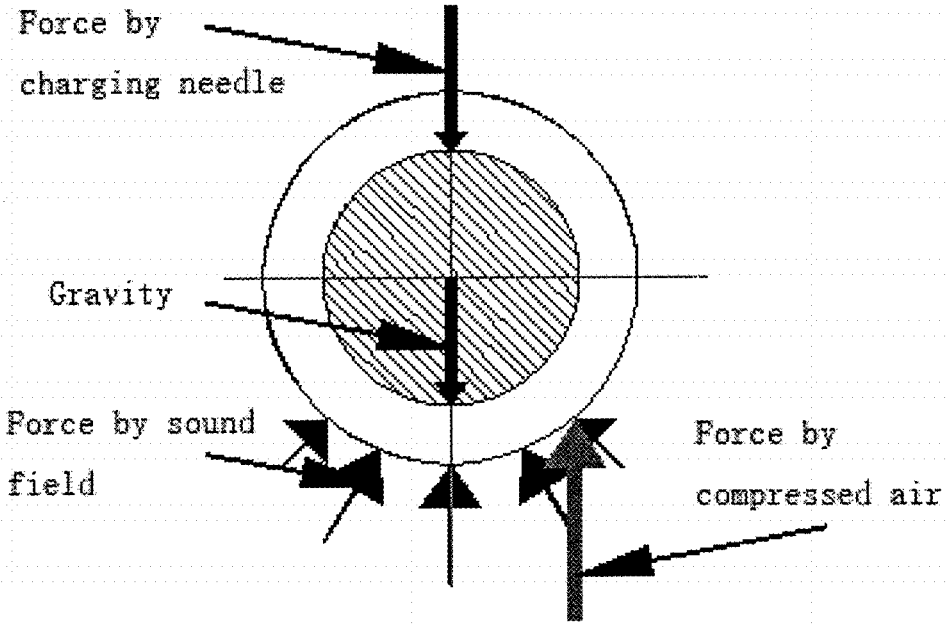
FIG. 5 is the analysis of the force of the suspended ball.
Figure 6A:
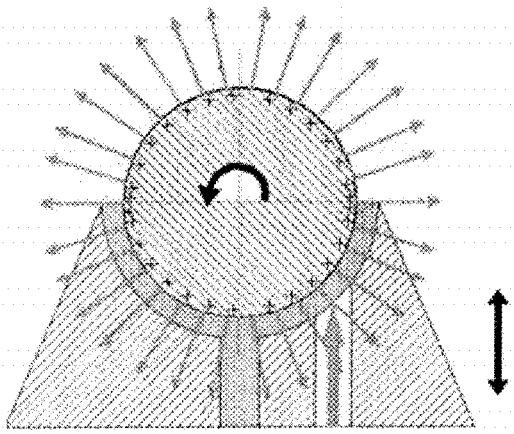
FIG. 6 is a schematic diagram of the atomization process of the droplets.
Figure 6B:
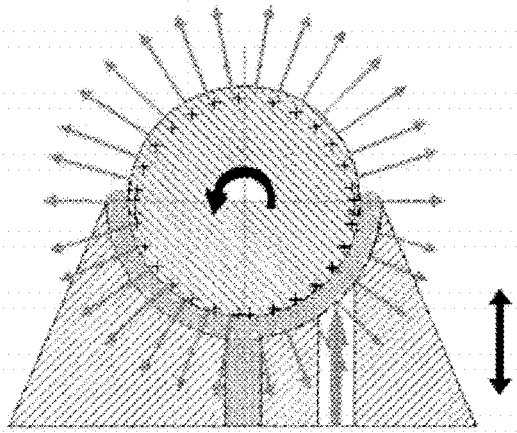
Figure 6C:
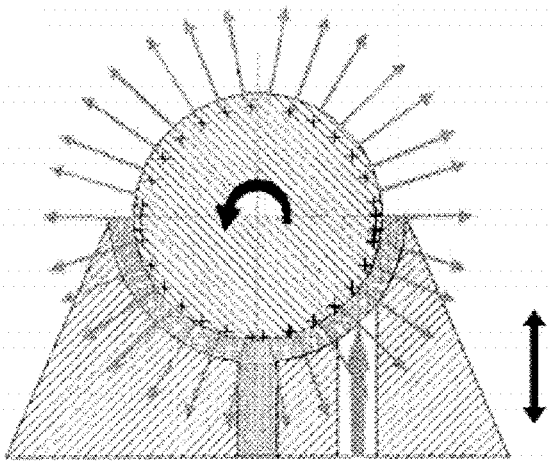
Figure 6D:
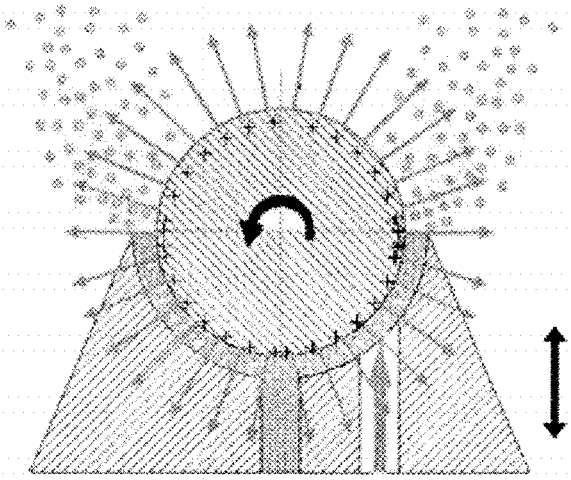

The operation of the nozzle is shown in FIG. 4. In FIG. 4, the levitating ball 8 is close to the top end of the nozzle due to the gravity and pressing force from the charging needle 2. When the nozzle is working, under the piezoelectric ceramics 6 drive, the horn 3 and the piezoelectric ceramic 6 resonance, ultrasonic vibrations are produced along with a focused radiation field in the semi circular end. The levitating ball 8 overcomes gravity and the force from the charging needle 2, under the action of the sound radiation force, suspending it upwards. Thus, it forms a gap between the levitating ball 8 and the top face of the horn. The intake channel 7 is located in the eccentric axial position of the nozzle, and the diameter of the inlet channel 7 is approximately 1 mm. When the nozzle is operated, compressed air 17 is supplied with a flow rate of 50-100 m/s in the intake channel 7. The compressed air 17 drives the levitating ball 8 to rotate at high speeds so that the droplets do not stain the levitating ball 8. The high-speed rotation of the levitating ball 8 and many droplets collide so that the droplets are atomized again. The force analysis of the levitating ball 8 is shown in FIG. 5.

The atomization process of the droplet is shown in FIG. 6. The atomization process is divided into four stages:

(1) The liquid becomes a liquid film at the top surface of the ultrasonic nozzle, as shown in FIG. 6 (*a*).

(2) The liquid is atomized by ultrasonic action on the hemispherical atomized end face, as shown in FIG. 6 (*b*). The cavitation effect of the ultrasonic wave on the liquid results in the generation of micro-shocks to produce atomization. The high-frequency vibrating air flow with the turbulent, pulsed liquid film will be drawn into filaments and further broken into droplets and an aerosol spray.

(3) The liquid is subjected to secondary atomization by the electric field generated by the charged levitating ball 8 as shown in FIG. 6 (*c*). High-voltage static electricity reduces the surface tension and viscous resistance of the liquid, causing the liquid to be easily broken into smaller droplets and making the droplet size distribution even more uniform. When the droplets are charged, they are easily atomized for a second time in the high voltage electrostatic field, which further reduces the droplet size. At the same time, for the charged droplets in the charge between the repulsion, the degree of dispersion increased. The charged droplets can be attracted to leaves with the opposite polarity of the charge so that they can be easily captured by the target under the action of polarization and gravitational forces.

4) The liquid is ejected by the centrifugal force of the aerodynamic force and the high-speed rotation of the levitating ball 8, which is shown in FIG. 6 (*d*).

Figure 7:
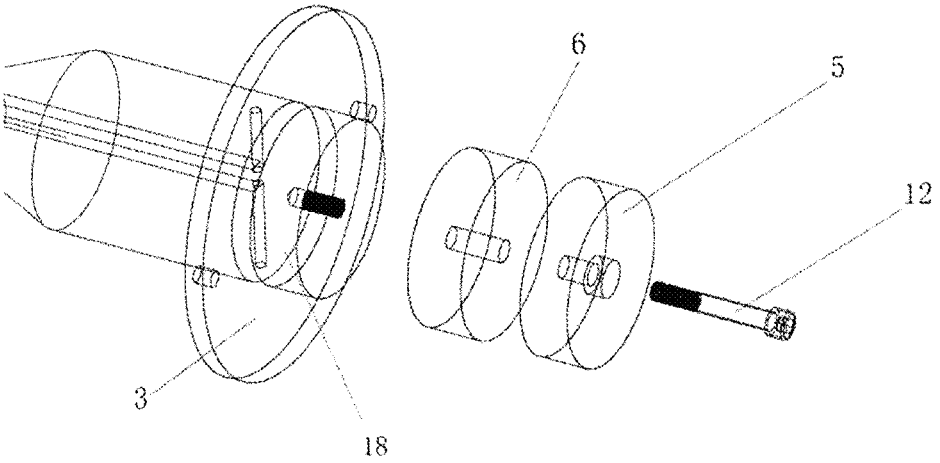
FIG. 7 is a schematic diagram of the bottom structure of the electrostatic atomization nozzle.
Figure 8:
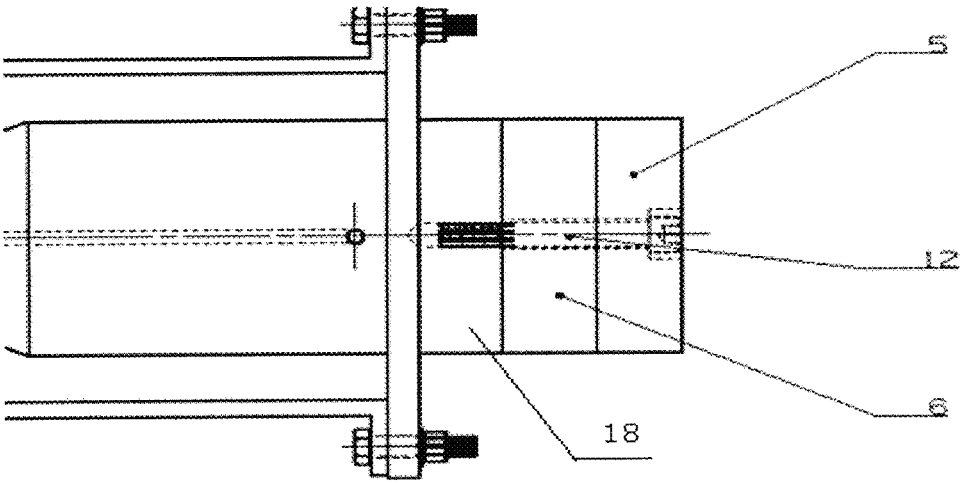
FIG. 8 is a schematic diagram of the bottom of the electrostatic atomization nozzle.

The lower end of the nozzle connection structure is shown in FIG. 7 and FIG. 8. A set screw 12 was used through the transducer back cover 5 and the piezoelectric ceramics 6 and connected to the tip of the ultrasonic horn 3 while fixing the piezoelectric ceramic 6 and the front and back covers. The diameter of the socket screw 12 is smaller than the radius of the center hole of the piezoelectric ceramics 6, and it can prevent a short circuit caused by contact between the socket screw and the piezoelectric ceramics, which might affect the normal operation of the nozzle.

Figure 9:
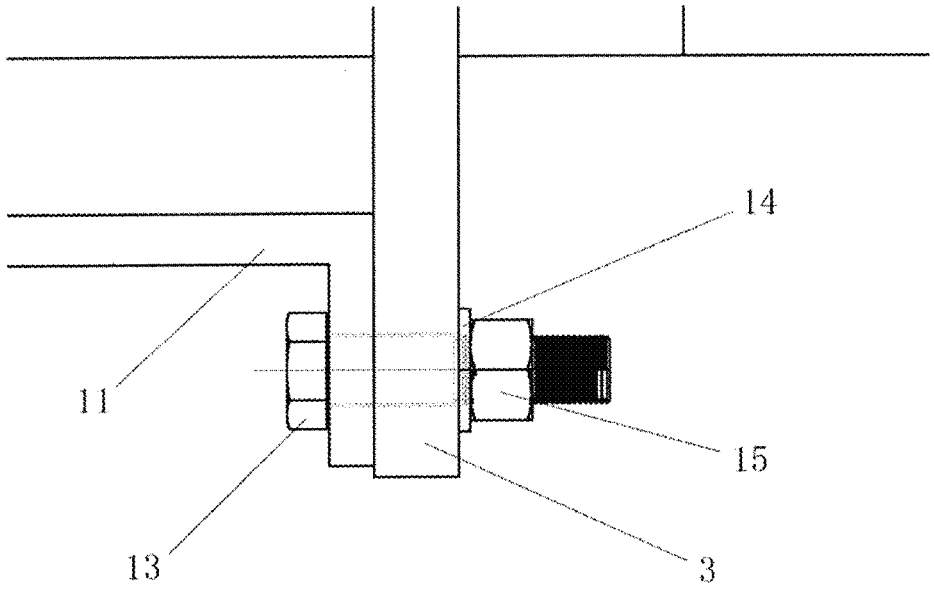
FIG. 9 is a diagram of the nozzle bracket connection.

As shown in FIG. 8 and FIG. 9, the bracket 11 and the horn 3 are connected by bolts 13. This structure is simple, and it is easy to install and disassemble during maintenance. At the same time, it can increase the preload to prevent loosening and does not cause a connection material composition phase change. The gasket 14 is sandwiched between the nuts 15 and the ultrasonic horn 3, which prevents the nut 15 from loosening during the operation of the nozzle, increase the bearing area and prevent the screw 12 bolts from being damage.

Figure 10:
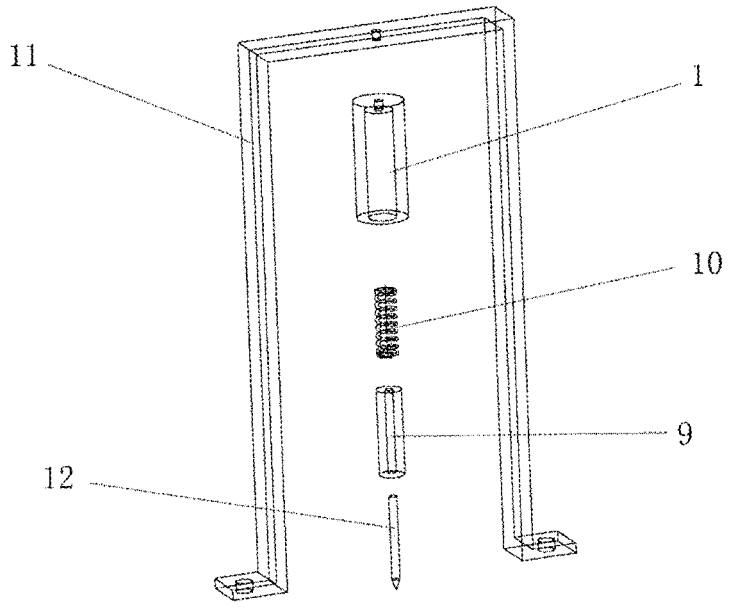
FIG. 10 is a schematic diagram of the stent and the charging needle structure.

As shown in FIG. 10, the surface of the charging needle 2 is designed with an insulation sleeve 9 to prevent the spring 10 and set 1 from being in contact with electricity. The diameter of the insulation sleeve 9 is greater than the diameter of the spring 10 and less than the inner diameter of the socket 1, and the spring 10 can resist the insulation sleeve 9 so that the charging needle 2 reciprocates in the socket 1. The upper surface of the socket 1 is fixed to the bracket 11 by welding. At the same time, in the center of the bracket 11 and the socket 1, a small hole is designed to let the live wire pass deep into the socket 1 and be directly connected to the charging needle 2. It can make the charge needle 2 charged, to achieve the goal of electrostatic atomization.

Figure 11:
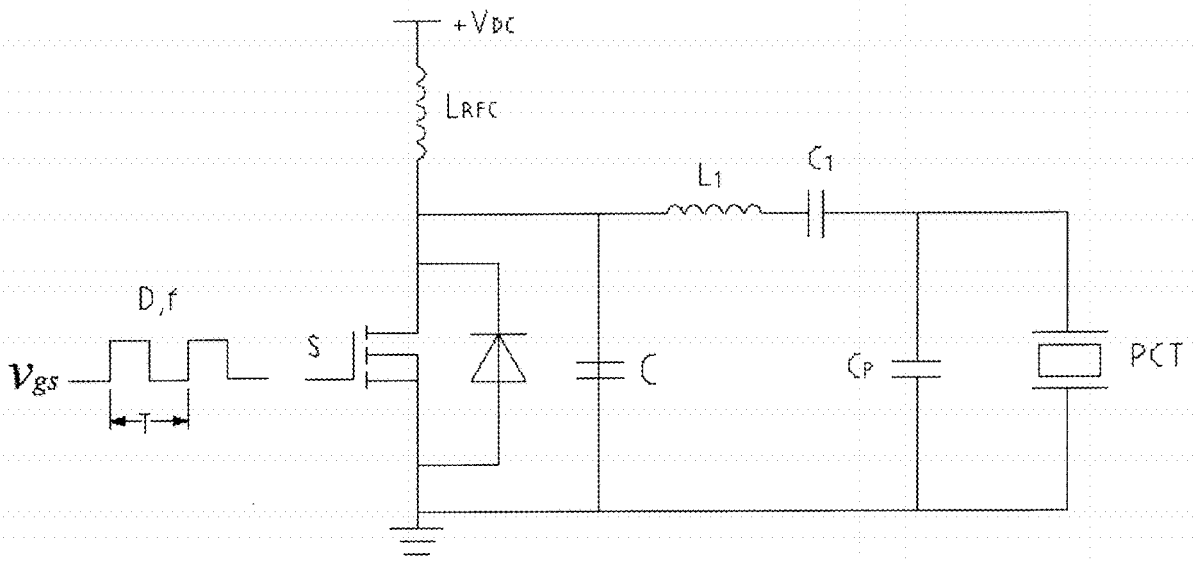
FIG. 11 is a diagram of the nozzle drive circuit.

The driver circuit of the nozzle is shown in FIG. 11. The structure of the circuit is simple; it is a single-ended circuit, mainly composed of six parts: choke inductor $L_{RFL}$, switch S, equivalent parallel capacitor C (the sum of the switch input capacitor, the distributed capacitor, and an external capacitor), series resonant inductor $L_1$, series resonant capacitor $C_1$, and impedance matching capacitor $C_P$. The working principle is as follows: the square wave signal of working frequency f (nozzle series resonant frequency) controls the turning on or off of the switch S. At this time, switch S outputs a pulse voltage. The nozzle at both ends of the switching frequency f harmonic signal is suppressed, through the frequency selection network $C$-$C_1$-$L_1$-$C_P$, and the base frequency signal is selected. In this way, two ends of the nozzle can be obtained with the square wave signal with the frequency of a sinusoidal AC signal. On the other side, the frequency selective network can be used to adjust the load impedance. Simply put, the switch S is operated by the active square wave signal cycle, the DC energy from the power supply can be converted to AC energy. The frequency selection network can only let the base frequency current flow, thus encouraging the nozzle to work.

A simple summary of the ultrasonic atomization drive circuit in the various stages of the work process is as follows:

First, choke inductance $L_{RFL}$ ndds to be large enough to allow only the DC signal to pass through, while the AC signal has a large impedance, thereby suppressing the AC signal through. This causes the supply current not to drastically change when the switch is turned on or off. Therefore, the input current can be considered as a constant flow.

Second, the fundamental frequency resonant circuit quality factor needs to be high enough. The flow passing through the ultrasonic nozzle can be regarded as a sine wave.

Finally, the conduction resistance of switch S is ignored, and switch S can instantaneously complete the process of turning on or off, which is the time for switch tube S to rise or fall to zero.

Figure 12:
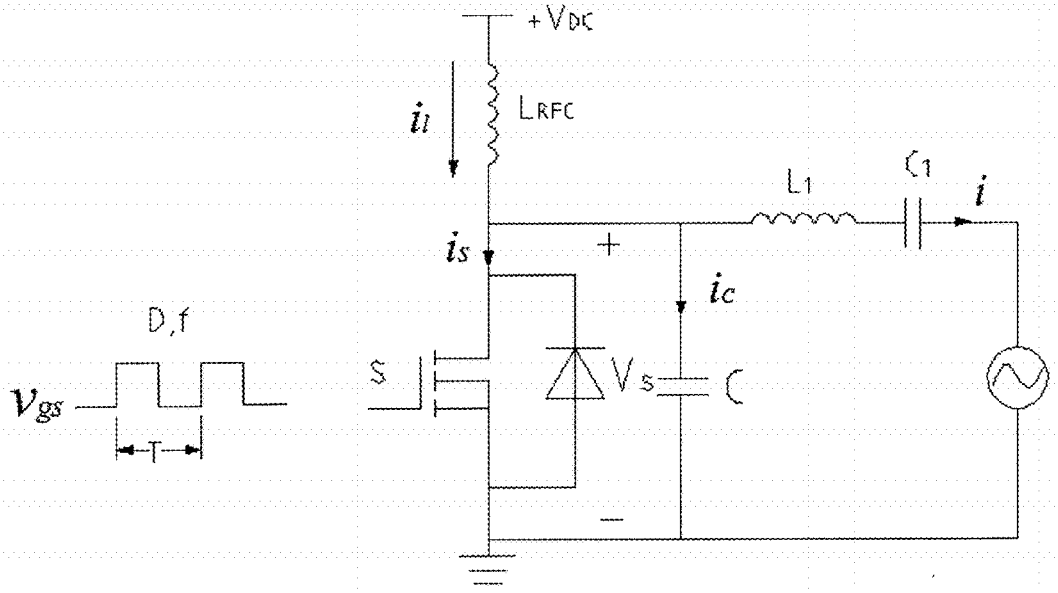
FIG. 12 is a simplified model of the nozzle drive circuit.
Figure 13:
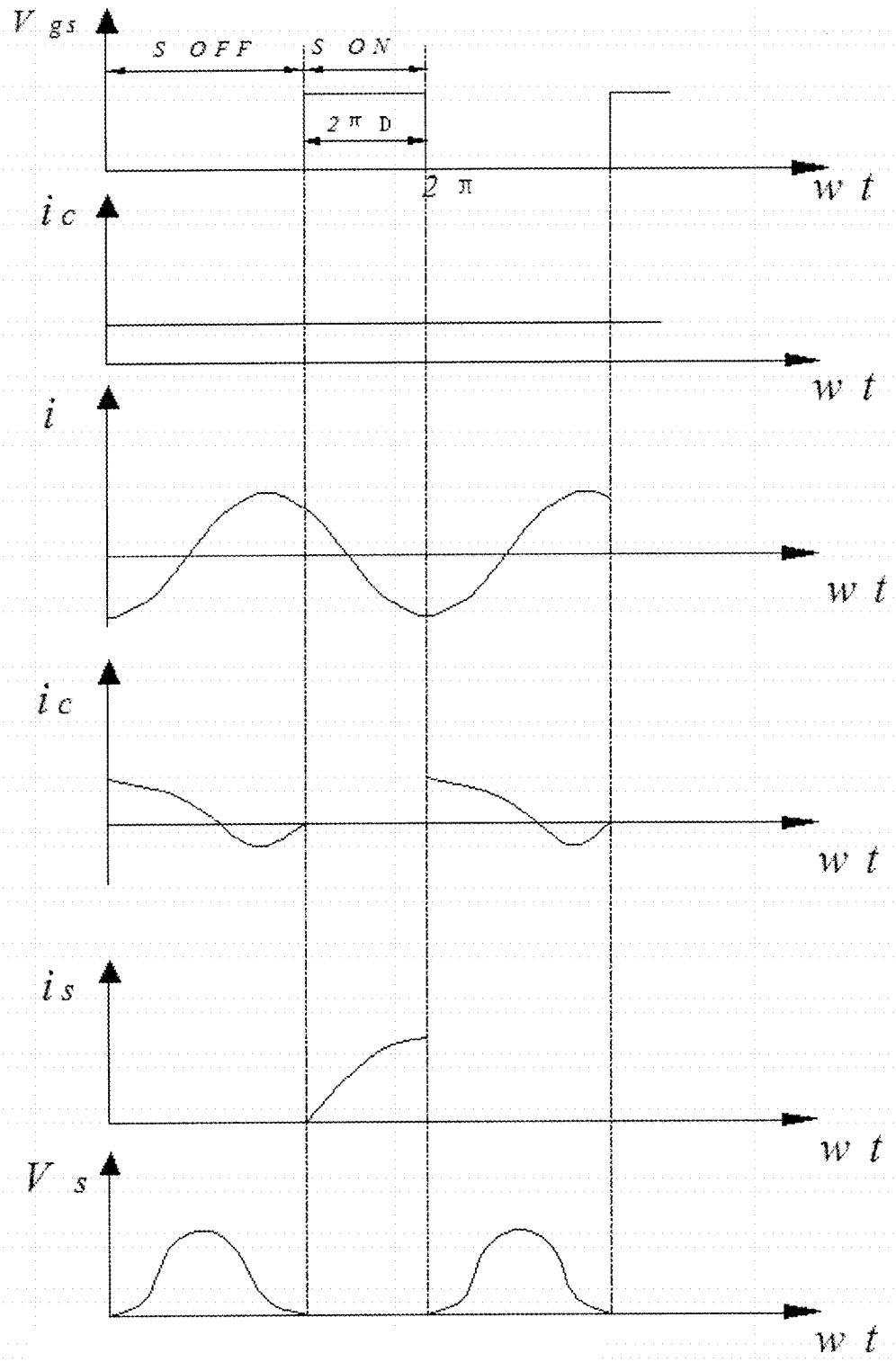
FIG. 13 is a waveform figure of the working principle of the nozzle drive circuit at different stages.

As shown in FIG. 12 and FIG. 13, the drive circuit is simplified for analysis where $V_{gs}$ is the driving signal of switch S, V, is the voltage waveform across switch S, $i_s$ the current flowing through switch S, $i_c$ is the current flowing through parallel capacitor C, and i is the current flowing through the nozzle.

Stage I ($t_0 \leq t \leq t_1$)

Before moment $t_0$, switch S is turned on, and DC voltage $V_{DC}$ charges the choke inductance $L_{RFC}$ and lets it store energy. Parallel capacitor C beside switch S is short-circuited. Switch tube S, resonant inductance $L_1$, resonant capacitor $C_1$, and the nozzle form a series resonant circuit. At time $t_0$, switch S is disconnected. As the inductor current cannot be mutated, the current flowing through switch S is instantaneously turned to parallel capacitor C next to switch S. The voltage across parallel capacitor C rises gradually from zero. At this point, parallel capacitance C, resonant inductance $L_1$, resonant capacitor $C_1$ and the nozzle together constitute a series resonant circuit. The energy stored in choke inductance $L_{RFC}$ previously is transferred to the resonant circuit. As current $i_C$ decreases, Vs reaches the highest value until it is reduced to zero; when $i_C$ changes from zero to negative, parallel capacitor C begins to discharge; when the discharge of parallel capacitor C is complete, then the current flowing through the RF choke $i_1$ equals to current i in the resonant circuit, and switch S turns on immediately and enters the next stage. At this time, switch S becomes a zero current, zero voltage switch, and the switching conduction loss is almost zero.

Stage II ($t_1 \leq t \leq t_2$)

At time $t_2$, switch S is turned on and shunt capacitor C is shorted. According to the Kirchhoff current law, the current of choke inductance $L_{RFC}$ is divided into two conditions, one flow goes through switch S, and the other goes through the nozzle. As resonant current i gradually decreases, current $i_S$ flowing through switch S is increasing. The resonant circuit consists of series resonant capacitor $C_1$, series resonant inductance $L_1$, and the nozzle. Resonant capacitor $C_1$ and resonant inductor $L_1$ store energy during the exchange; one reaches the maximum, the other just falls down to zero. When resonant capacitor $C_1$ reaches the resonant peak, resonant current i drops to zero. Thereafter, resonant capacitor $C_1$ is discharged to resonant inductor $L_1$, and resonant current i is reversed. The circuit then beings the next high-frequency cycle of working stage I.

This low-frequency electrostatic atomization nozzle drive circuit has the following advantages:

1. The parasitic parameters of the circuit can be effectively absorbed. The junction capacitance of the switch tube is absorbed by the parallel capacitor of the resonant circuit, which can effectively reduce the influence of parasitic parameters on the circuit performance.
2. The circuit working efficiency is high. From the above analysis, current $i_S$ flowing through switch S, and voltage Vs across tparallel capacitance C of the switch are not present at the same time. Thus, at any one time, the product of $i_S$ and $V_S$ is zero, and the loss of switch S is almost zero. The ideal efficiency is 100%, and the actual efficiency reaches up to 90% or more.

The embodiment is a preferred embodiment of the present invention, but the invention is not limited to the above-described embodiments. It will be apparent to those skilled in the art that any obvious modifications, substitutions, or variations are intended to be within the scope of the present invention without departing from the spirit of the invention.

The invention claimed is:

1. A low-frequency electrostatic ultrasonic atomization nozzle, comprising:

a back cover;

an ultrasonic vibrator comprising a transducer back cover, piezoelectric ceramics, and a transducer front cover;

an ultrasonic horn, the length of which is determined as the half-length of an ultrasonic wave, the ultrasonic horn comprising a liquid inlet channel configured in an axial center thereof and an intake channel configured at a position that deviates from the axial center of the ultrasonic horn, wherein the intake channel is configured to inject compressed air and has a concave spherical surface configured for levitating balls;

a fastening screw, wherein the fastening screw is attached through center holes of the transducer back cover, the piezoelectric ceramics, and the transducer front cover in sequence;

a levitating ball with a V-shaped annular groove on its outer surface that is made of a metallic conductor;

a charging needle restrained by a spring and the V-shaped annular groove on the levitating ball that uninterruptedly charges the levitating ball;

an insulating sleeve configured to insulate the charging needle;

a bracket; and a socket connecting the bracket and the insulating sleeve; and a spring in the insulating sleeve and configured to ensure the charging needle uninterruptedly contacts the levitating ball, wherein the bracket is connected with flanges of the ultrasonic horn by set screws, and wherein the bracket fixes the socket.

2. The low-frequency electrostatic ultrasonic atomization nozzle of claim 1, wherein the depth of the annular groove on the outer surface of the levitating ball is 1-2 mm.

3. The low-frequency electrostatic ultrasonic atomization nozzle of claim 1, wherein the levitating ball and the charging needle are made of copper.

4. The low-frequency electrostatic ultrasonic atomization nozzle of claim 1, wherein the diameter of the insulating sleeve is 0.2-0.4 mm greater than the diameter of the spring and 0.05-0.1 mm less than the diameter of the socket, and wherein the spring is against the insulating sleeve to restrict reciprocating movement of the charging needle in the socket.

5. The low-frequency electrostatic ultrasonic atomization nozzle of claim 1, wherein two same-sized holes are respectively drilled in the bracket and the socket to enable a charged wire to pass through the socket and the bracket to directly charge the charging needle.

6. The low-frequency electrostatic ultrasonic atomization nozzle of claim 1, wherein the bracket is a rectangular frame, wherein the set screws comprise bolts and nuts, and wherein the ultrasonic horn is fitted with a gasket.

7. The low-frequency electrostatic ultrasonic atomization nozzle of claim 1, wherein the ultrasonic horn and the transducer back cover are made of insulating ceramic materials.

8. The low-frequency electrostatic ultrasonic atomization nozzle of claim 1, comprising a main part, wherein the main part comprises the transducer back cover, the piezoelectric ceramics, the transducer front cover, and the ultrasonic horn, and wherein a vibration frequency of the low-frequency electrostatic ultrasonic atomization nozzle is in a range of 20-100 kHz.

9. The low-frequency electrostatic ultrasonic atomization nozzle of claim 1, wherein the charging needle applies a static voltage of less than 500 V to the levitating ball.

10. The low-frequency electrostatic ultrasonic atomization nozzle of claim 1, wherein the diameter of the levitating ball is in a range of from 13 mm to 17 mm.

11. The low-frequency electrostatic ultrasonic atomization nozzle of claim 1, wherein the charging needle applies a static voltage of less than 2000 V to the levitating ball.

* * * * *